US007677389B2

(12) United States Patent
Czopor, Jr. et al.

(10) Patent No.: US 7,677,389 B2
(45) Date of Patent: Mar. 16, 2010

(54) COMMODITIES PACKAGE

(75) Inventors: Edmund Czopor, Jr., Burlington, CT (US); Richard Hart, Burlington, CT (US); Timothy Lebeau, Avon, CT (US); Susan Lapadula, Canton, CT (US); Thomas Pelletier, Wallingford, CT (US)

(73) Assignee: The Stanley Works, New Britain, CT (US)

( * ) Notice: Subject to any disclaimer, the term of this patent is extended or adjusted under 35 U.S.C. 154(b) by 713 days.

(21) Appl. No.: 11/441,171

(22) Filed: May 26, 2006

(65) Prior Publication Data

US 2007/0272571 A1 Nov. 29, 2007

(51) Int. Cl.
*B65D 85/24* (2006.01)

(52) U.S. Cl. ..... 206/340; 206/497; 206/806; 220/8

(58) Field of Classification Search ..... 206/338, 206/340, 341, 343–347, 461, 468, 459.1, 206/497, 806; 220/8
See application file for complete search history.

(56) References Cited

U.S. PATENT DOCUMENTS

| | | | | |
|---|---|---|---|---|
| 3,148,770 | A | 9/1964 | Cosman | |
| 3,187,889 | A | 6/1965 | Sinclair | |
| 3,313,407 | A | 4/1967 | Palm, Jr. | |
| 3,627,116 | A * | 12/1971 | Cooper | 206/497 |
| 3,721,339 | A | 3/1973 | Seyer | |
| 3,861,528 | A | 1/1975 | Damuth | |
| 3,952,872 | A | 4/1976 | Consiglio, Jr. | |
| 4,072,232 | A | 2/1978 | Marsman et al. | |
| 4,111,267 | A | 9/1978 | van der Lely | |
| 4,331,240 | A * | 5/1982 | Vanasse | 206/806 |
| 4,375,850 | A | 3/1983 | Smyth et al. | |
| 4,484,681 | A * | 11/1984 | Consiglio, Jr. | 206/499 |
| 4,928,823 | A * | 5/1990 | Campbell | 206/338 |
| 5,054,727 | A | 10/1991 | Campbell et al. | |
| 5,299,686 | A * | 4/1994 | Bromley et al. | 206/338 |
| 5,339,953 | A * | 8/1994 | Alex et al. | 206/340 |
| 5,417,339 | A * | 5/1995 | Liu | 206/338 |
| 5,562,212 | A * | 10/1996 | Rosler | 206/443 |
| 5,660,278 | A | 8/1997 | Rigal et al. | |
| 5,680,949 | A * | 10/1997 | Roesler | 220/8 |
| 5,730,296 | A | 3/1998 | Limmer | |
| 5,901,860 | A | 5/1999 | Nowicki | |
| 6,135,289 | A | 10/2000 | Miller | |
| 6,364,134 | B1 | 4/2002 | Christy | |
| 6,499,601 | B1 | 12/2002 | Foster et al. | |

* cited by examiner

*Primary Examiner*—Luan K Bui
(74) *Attorney, Agent, or Firm*—Pillsbury Winthrop Shaw Pittman LLP

(57) ABSTRACT

A commodities package is provided for containing commodities, such as staples. The package includes a base container and a cover, the base container and cover having interengaging structure in order to hold them together. The base container and cover are wrapped with shrink wrap to provide a sealed package. An outer package contains a plurality of commodity packages and facilitates loading of the commodity packages onto a display structure. The outer package is manually alterable so that it supports each of the plurality of commodity packages while the display structure is received by hanger members provided on the commodity packages. Once the commodity packages are loaded onto the display structure, the outer package is pulled away.

18 Claims, 9 Drawing Sheets

COMMODITIES PACKAGE

FIELD OF THE INVENTION

The present invention relates to packaging for commodities.

BACKGROUND OF THE INVENTION

Numerous commodity packages are known in the art. However, there is a constant need in the industry to improve upon existing packaging products by making them more efficient, adaptable for different commodities, durable, and/or easy to use.

SUMMARY OF THE INVENTION

In one embodiment, a commodity package is provided for containing commodities and comprises a generally rectangular cross-section base container and a generally rectangular cover for cooperating with the base container and covering the base container. The package further includes interengaging structure provided on the base container and the cover for releasably securing the cover to the base container and shrink wrap disposed around the base container and the cover. A plurality of staples or other commodities may be disposed within the base container.

In another embodiment, a package system is provided that comprises a plurality of commodity packages, each having hangers. An outer package contains the plurality of commodity packages and the commodity packages are arranged within the outer package such that the hangers are aligned to receive an elongated hanger member. The outer package has a frangible portion that enables manual alteration of the outer package to expose the hangers while the outer package supports bottom portions of the commodity packages. After the hangers receive the elongated hanger member, the outer package can be pulled away from the commodity packages while leaving them hanging on the elongated hanger member. receive the elongated hanger member, the outer package can be pulled away from the commodity packages while leaving them hanging on the elongated hanger member.

In accordance with another aspect of the present invention, a commodity package is provided that includes a generally rectangular cross section base container and a generally rectangular cross section cover for cooperating with the base container and covering the base container. A hinge mechanism attaching the cover to the base container is provided for movement between a closed position and an open position. The commodity package further includes shrink wrap disposed around the base container and the cover, and commodities are disposed within the base container.

BRIEF DESCRIPTION OF THE DRAWINGS

The above-mentioned and other features and advantages of the present invention, and the manner of attaining them, will become more apparent and the disclosure itself will be better understood by reference to the following description taken in conjunction with the accompanying drawings, wherein.

Figure 1:
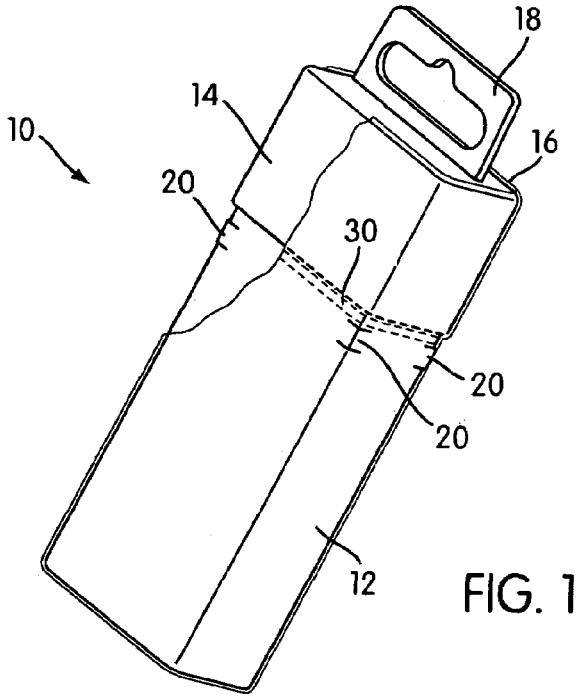
FIG. 1 is a perspective view of a sealed commodity package in accordance with an embodiment of the present invention.

The present invention will be described with reference to the accompanying drawings. Corresponding reference characters indicate corresponding parts throughout the several views. The description as set out herein illustrates an arrangement of the invention and is not to be construed as limiting the scope of the disclosure in any manner.

DETAILED DESCRIPTION OF THE INVENTION

FIG. 1 shows a package 10 for containing commodities, such as staples or other goods. The package 10 may have a generally rectangular cross section and includes a base container 12 and a cover 14. The base container 12 may include a rounded cut-out or access portion 28 that enables a user to remove contained commodities easily. The access portion 28 may, of course, be another shape, such as a triangular or square cutout, so that enhanced access is provided to the interior of the base container 12. In one embodiment, the container 12 and cover 14 are each integrally molded (e.g., injection molded) from a plastic material.

Figure 1A:
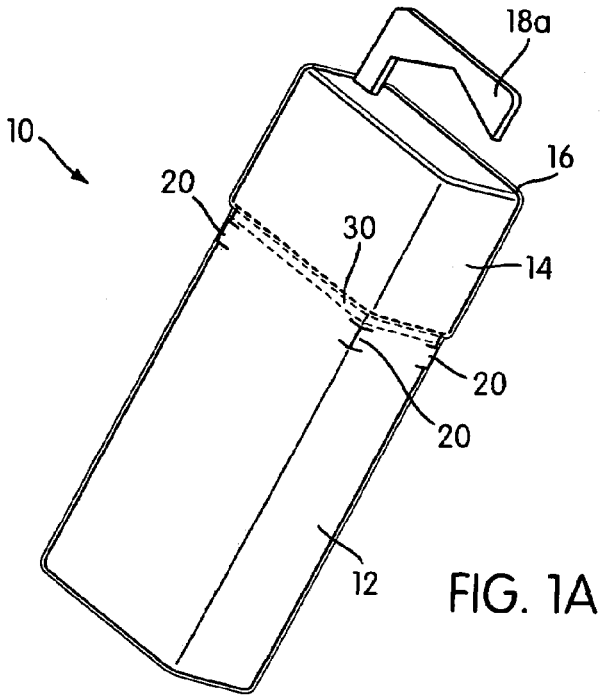
FIG. 1A is a perspective view of a cover of a commodity package in accordance with another embodiment of the present invention.

The cover 14 may have thereon a hanger member 18 for hanging the package 10 from a display or storage apparatus, such as an elongated rod, hook, or other display member. As shown in FIG. 1, the hanger 18 is a hole cut out of a piece of material, such as plastic, extending from the top of the cover 14. The hanger may alternatively be configured as an open hanger member 18*a*, as shown in FIG. 1A, such that the package 10 can be removed from a display member laterally.

Figure 2:
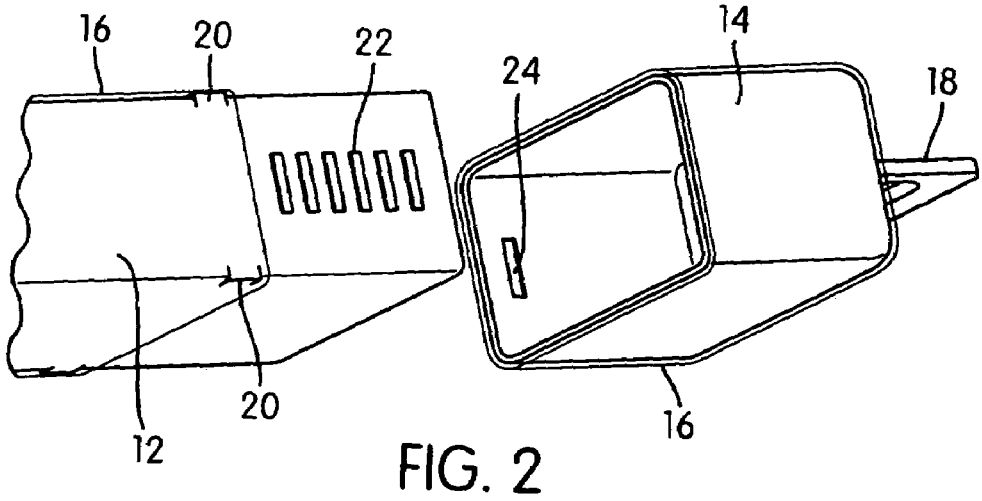
FIG. 2 is a perspective view in detail of interengaging structure in accordance with an embodiment of the present invention.
Figure 3:
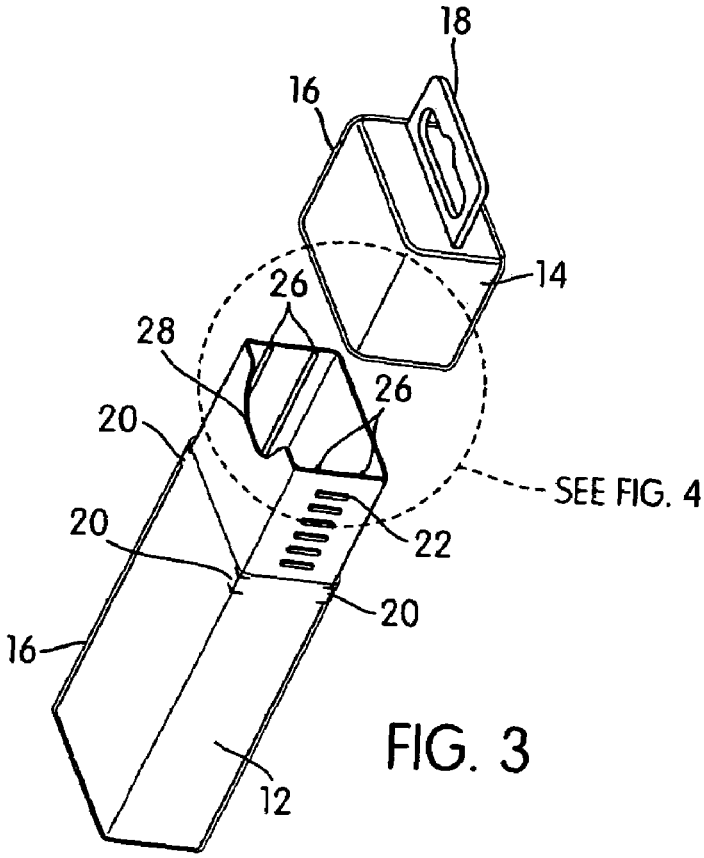
FIG. 3 is a perspective view of an open commodity package in accordance with an embodiment of the present invention.
Figure 4:
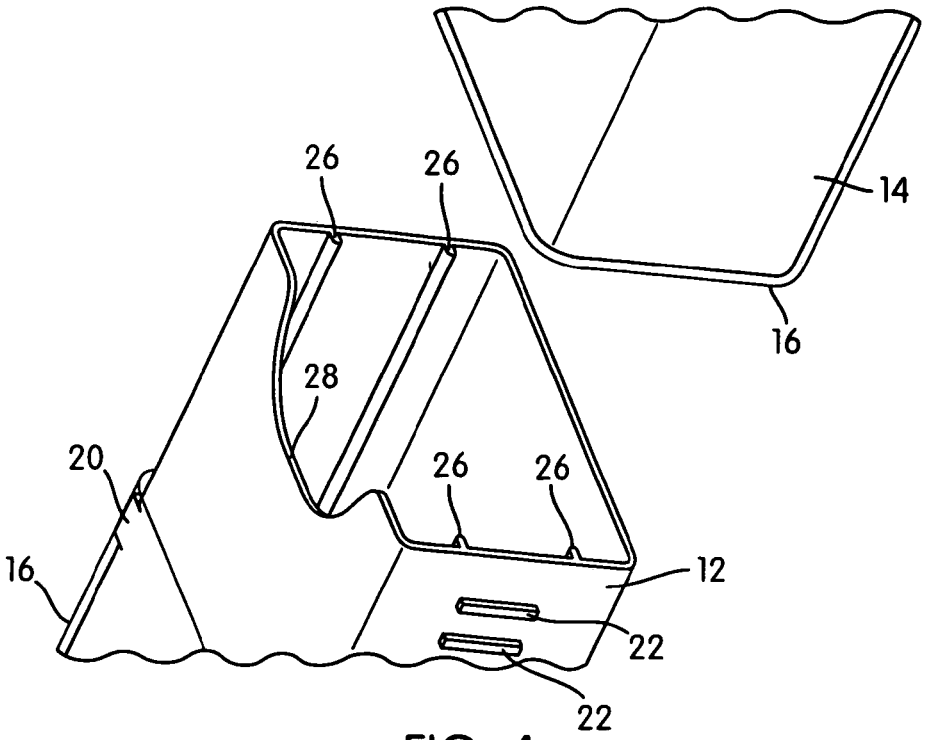
FIG. 4 is a perspective view in detail showing the inside of a commodity package in accordance with an embodiment of the present invention.

The cover 14 may be secured to the base container 12 by an interengaging structure such as protrusions 22 and 24 on each of the base container 12 and the cover 14, respectively, as shown in FIG. 2. The base container 12 is shown as having six protrusions 22 and the cover 14 is shown as having one protrusion 24. Any number of protrusions 22, 24 may be located on either of the base container 12 or the cover 14 in order to provide a secure fit. For example, the cover 14 may have six protrusions 24 while the base container 12 has one protrusion 22, or each of the base container 12 and the cover 14 may have the same amount of protrusions 22, 24, depending on the amount of resistance and/or security desired between the base container 12 and the cover 14. The protrusion 22 rests between any two of the protrusions 24. It can be appreciated, therefore, that protrusions 24 can be replaced by a plurality of spaced recesses that can receive the protrusion. In addition, the plurality of recesses or protrusions can be formed on the cover 14 rather than the base 12, with one or more protrusions formed on the base container 12.

As shown in the Figures, the base container protrusions 22 are formed on an outer surface of the base container 12 and the cover protrusions 24 are formed on an inner surface of the cover 14. This is the natural result of configuring the package 10 such that the cover 14 slides telescopically over the base container 12. A configuration of this type provides more space in the interior of the base container 12 for holding commodities. However, if the commodities are such that internal space within the base container 12 is available or if the reverse configuration is otherwise desired, the package 10 may be configured such that the base container 12 may telescopically slide over the cover 14. In such a case, the base container protrusions 22 would naturally be formed on an inner surface of the base container 12 and the cover protrusions 24 would accordingly be formed on an outer surface of the cover 14.

The base container 12 may include interior ribs 26 that extend substantially the length of the base container 12 and are located on any one or several of the interior surfaces of the base container 12. The interior ribs 26 may aid in locating and stabilizing staples or other commodities.

Once the commodities are placed into the base container 12 and the cover 14 is secured thereto, e.g., via engagement of protrusions 22, 24, the package 10 may then be sealed by application of shrink wrap 16. FIG. 1 shows shrink wrap 16 applied to the package 10 and depicts a portion of the shrink wrap 16 removed for illustrative purposes. The shrink wrap 16 extends over the entire length (or height) of the package 10 and further extends over at least a portion of the top surface of the cover 14 and the bottom surface of the base container 12 in order to establish an enclosing wrap. The shrink wrap 16 may have product information printed thereon. In one embodiment, the shrink wrap 16 functions to effectively lock the cover 14 to the base container 12 so that the cover 14 cannot be removed from the base container 12 without first removing the shrink wrap 16.

In a region of the shrink wrap 16 below the cover 14, the shrink wrap 16 may include a seam or tear-strip 30 that extends around the periphery of the package 10 to facilitate its opening. The tear-strip 30 may protrude from the shrink wrap a small amount so that a user may grip it and proceed to pull it away from and around the package 10 so that an opening in the shrink wrap 16 is created. The shrink wrap 16 may alternatively lack such a tear-strip 30. In this case, a user may simply cut an opening in the shrink wrap along a seam or other location with a blade or scissors so that the cover 14 may be removed. The shrink wrap 16 may have visual indicia thereon to indicate to a user a preferred location to make a cut. The shrink wrap 16 may, additionally or alternatively, be perforated to allow for increased ease of severance.

Projections 20 may be provided on the surface of the base container 12 in order to prevent the shrink wrap 16 from slipping off the package 10. Projections 20 are best shown in FIG. 2, in which they are depicted as being formed at the corners of the base container 12. The projections 20 may, however, be located at any suitable location on the base container 12. In this manner, the projections 20 engage with the shrink wrap 16 to prevent it from sliding off the base container 12 when the cover has been removed. An advantage of this is to keep the shrink wrap 16, which may have printed product information, attached to the package 10 so that a user does not misidentify the commodity. In addition, the projections 20 may aid in preventing the shrink wrap 16 from becoming displaced or removed during shipping, storing, display, or at any other time prior to the package 10 being opened.

Figure 5:
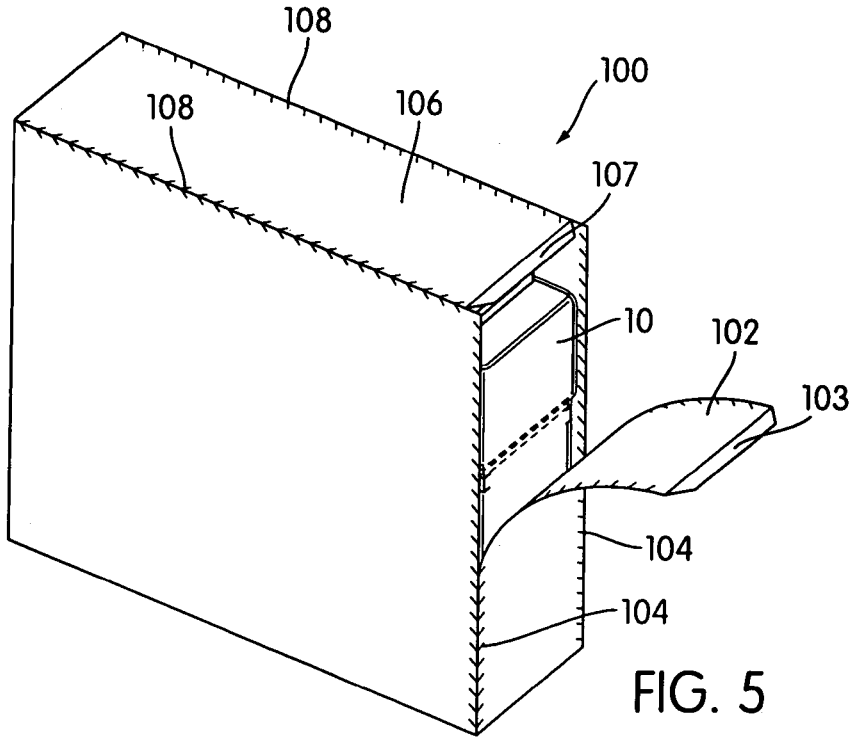
FIG. 5 is a perspective view of an outer package containing a plurality of commodity packages in accordance with an embodiment of the present invention.
Figure 6:
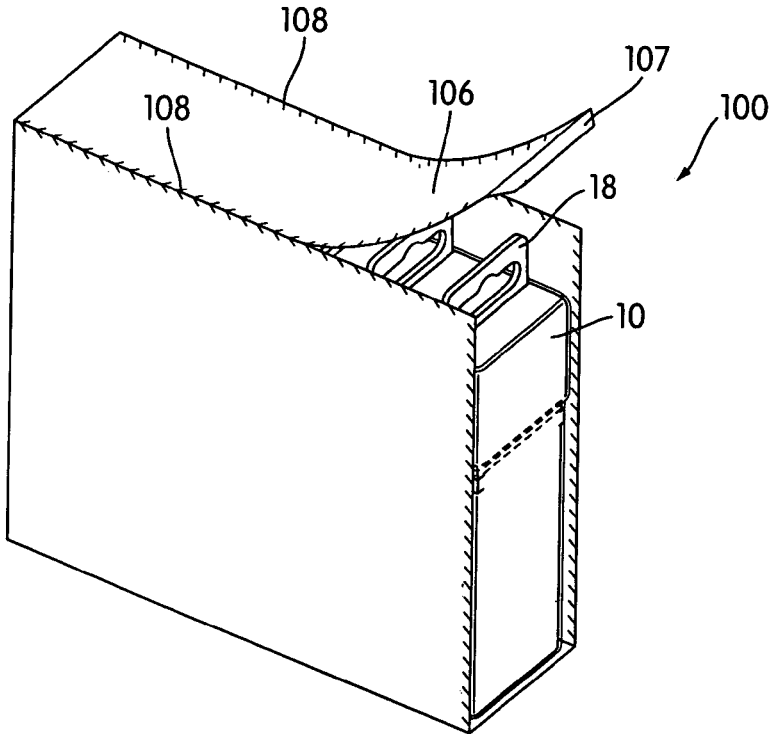
FIG. 6 is a perspective view of the outer package of FIG. 5 showing a step in its operation in accordance with an embodiment of the present invention.
Figure 7:
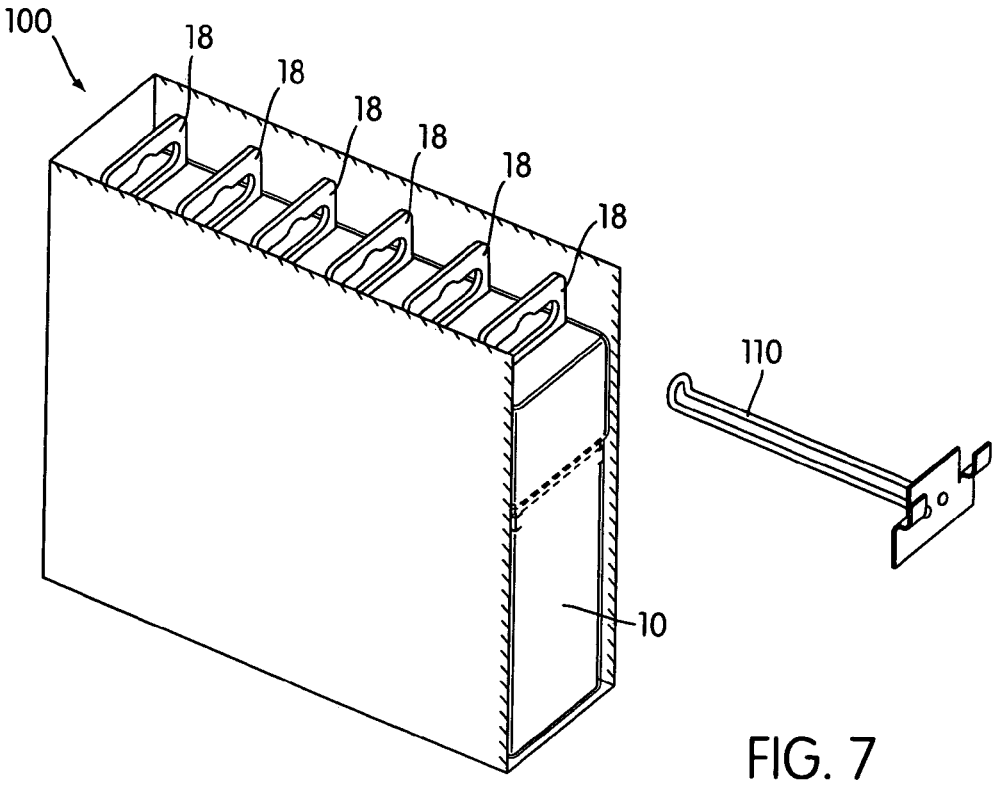
FIG. 7 is a perspective view of the outer package of FIG. 5 showing a further step in its operation in accordance with an embodiment of the present invention.

An outer package 100 is provided for containing a plurality of commodity packages 10 during transport or storage, as shown in FIGS. 5-7. The outer package 100 is configured to provide protection to the packages 10 as well as to facilitate the loading of packages 10 onto a display member 110, such as an elongated hanger or peg hook (see FIG. 7). In one embodiment, outer package 100 is formed from a paperboard material, although it is contemplated that other materials can be used.

The outer package 100 is constructed as a six-sided box and is sized to contain a number of commodity packages 10. In the Figures, the outer package is sized to contain six commodity packages 10, but one of skill in the art would recognize that the number of commodity packages 10 contained by the outer package 100 may vary depending on, for example, the amount of space available for a particular display.

To enable facilitated loading of the commodity packages 10 onto a display member 110, the outer package 100 includes a front panel 102 and a top panel 106 that may be manually removed along front perforations 104 and top perforations 106 provided in the outer package 100. Once the front 102 and top 106 panels are removed, the remainder of the outer package 100 provides sufficient support for the contained packages 10 so that a user may hold the outer package 100 and slide each of the hangers 18 of the commodity packages 10 onto a display member 110 in one motion, as shown in FIG. 7. The outer package 100 may then be moved downward, leaving the set of commodity packages 10 hanging from the display member 110 and ready for display.

To remove the front 102 and top 106 panels of the outer package 100, perforations 104, 108 may be provided along the corners of the outer package 100. Accordingly, as shown in FIG. 5, the front panel 102 is removed from the outer package 100 by grasping an optional tab 103 and pulling downward. The perforations 104 enable the front panel 102 to be frangible and to be neatly and easily removed from the outer package 100. Likewise, and as shown in FIG. 6, the top panel 106 is removed by grasping an optional tab 107 and pulling it in a direction away from the outer package 100 from the front to the back (as shown in FIG. 6) along the perforations 108. FIG. 7 shows the outer package 100 after removal of the front 102 and top 106 panels and ready for placement of the commodity packages 10 onto the display member 110, as described above.

As alternatives to the present invention, the front panel 102 may instead be removed from the bottom to the top or the top panel 106 may instead be removed from the back to the front. Alternatively, the front panel 102 and the top panel 106 may be integrated at the top front corner so that they may be removed from the outer package in one piece and in a single pulling motion. For example, the front panel 102 may have a tab 103 at its bottom edge. A user grasps the tab 103 and begins to pull the front panel 102 upward, along the perforations 104. When the entire front panel 102 is removed, a user may then continue to pull the tab 103 toward the rear of the outer package so that the top panel 106 is thereby removed as well. The set of commodity packages 10 are thereby exposed and are loaded onto the display member 110 as discussed above.

It should also be appreciated that in another embodiment only an upper portion of the front panel can be removed, to permit access to an elongated rod or display member 110 into the plurality of hooks 18 or 18*a* while leaving the lower portions of the front panel intact. Because the top panel 106 is removed, the outer package 100 can simply be lowered away from the display member 110.

Figure 8:
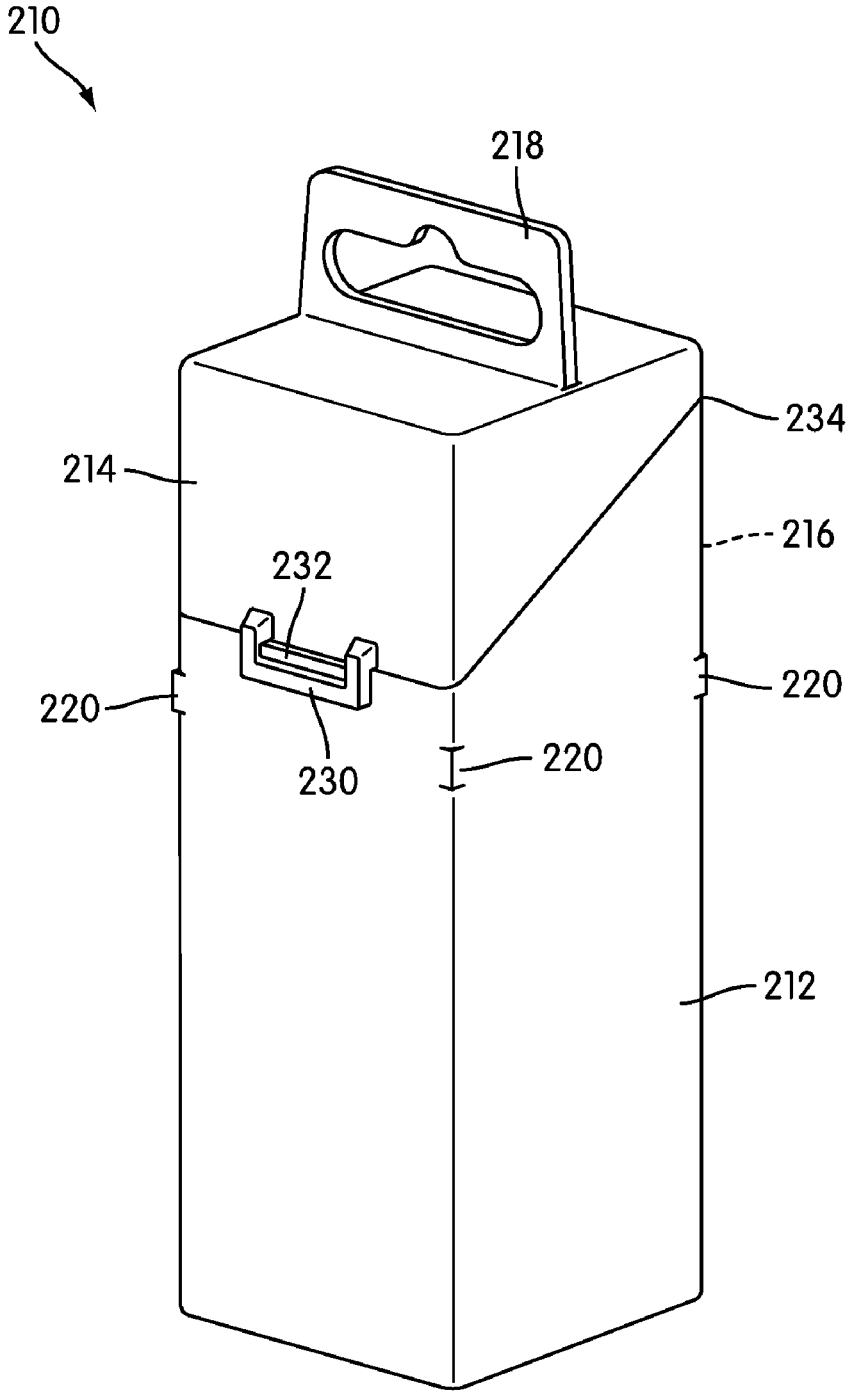
FIG. 8 is a perspective view of a commodity package in a closed configuration in accordance with another embodiment of the present invention.
Figure 9:
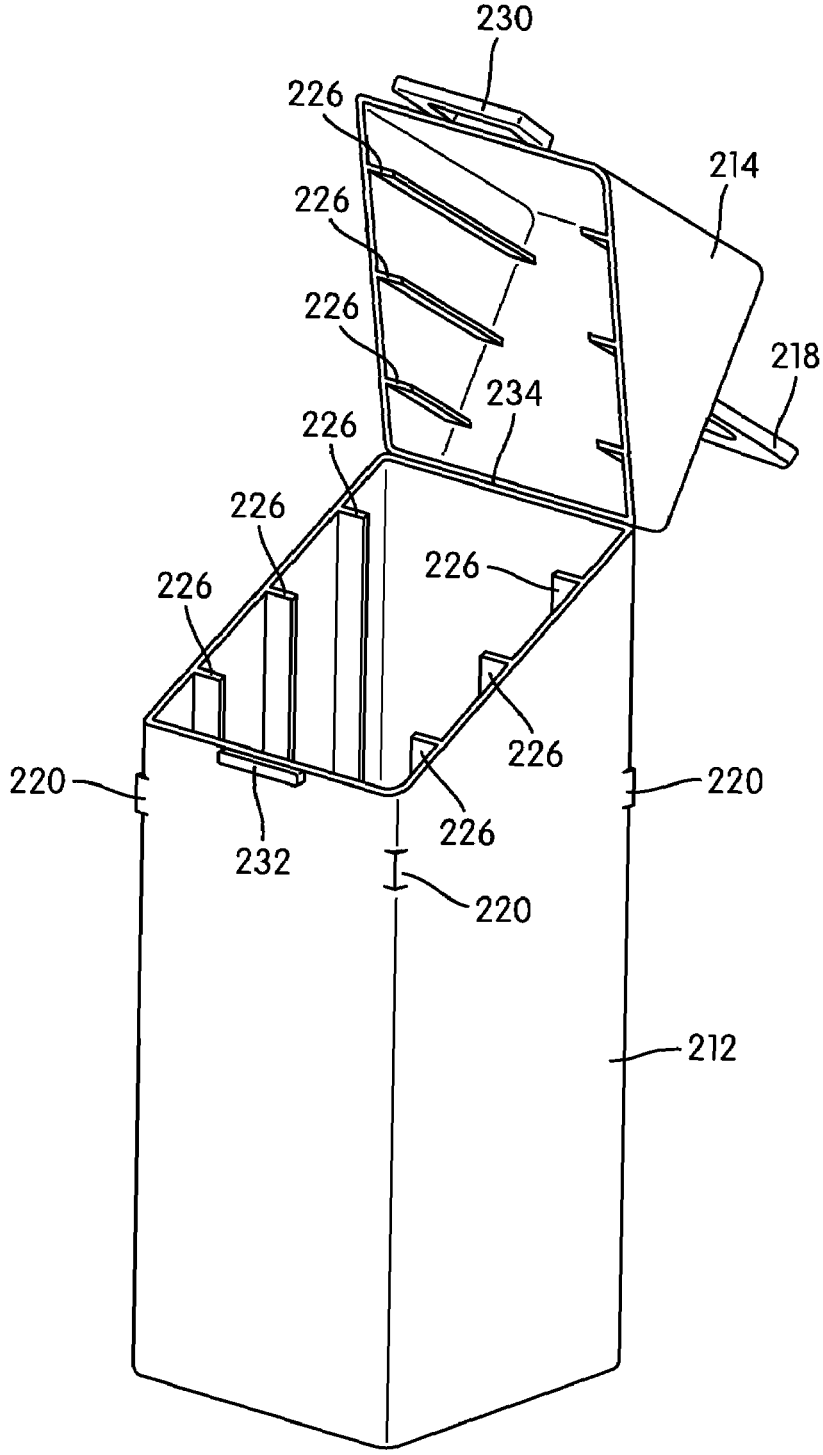
FIG. 9 is a perspective view of a commodity package in an open configuration in accordance with the embodiment of the present invention shown in FIG. 8.
Figure 10:
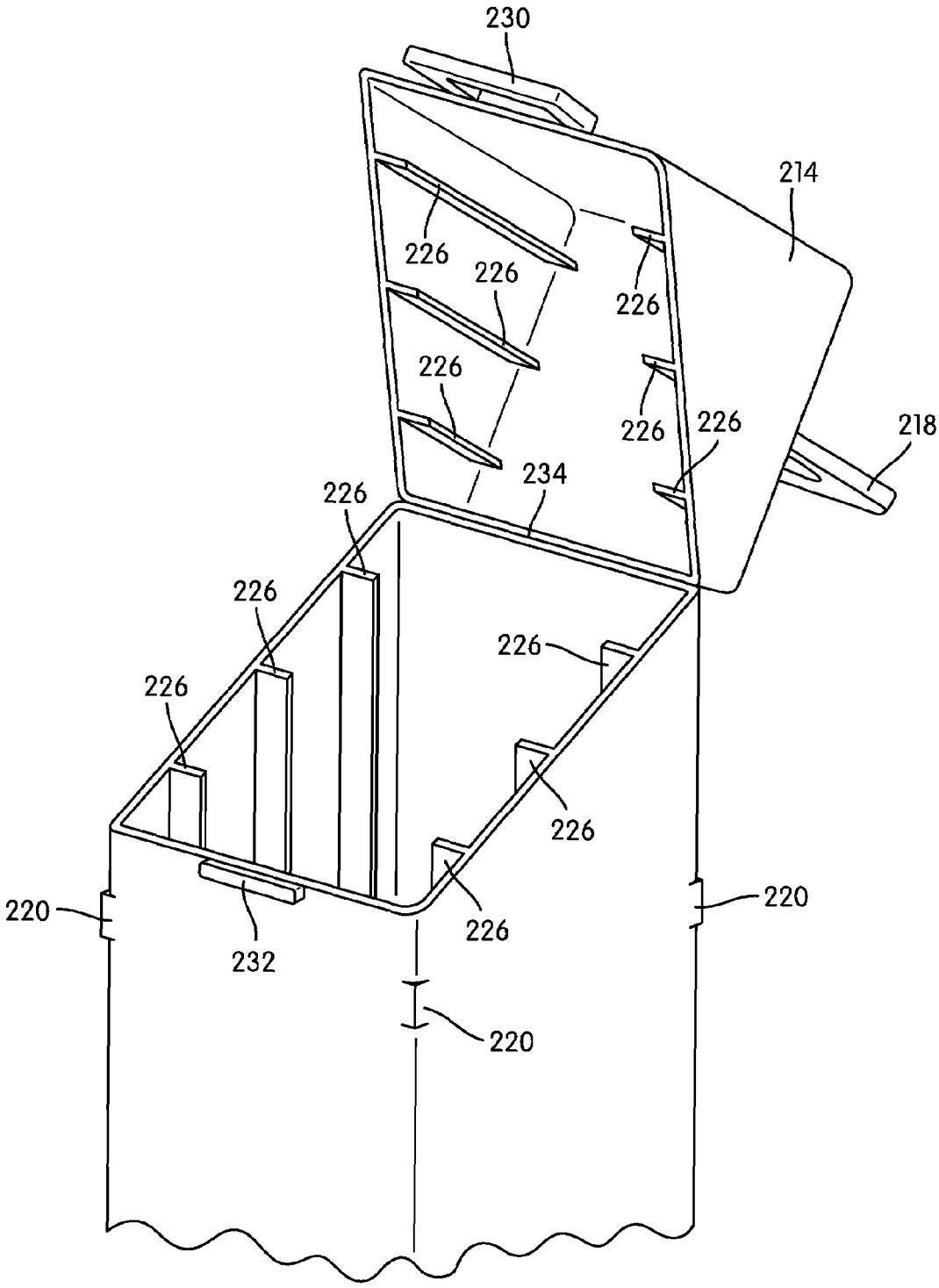
FIG. 10 is a perspective view in detail showing a commodity package in an open configuration in accordance with the embodiment of the present invention shown in FIG. 8.
Figure 11:
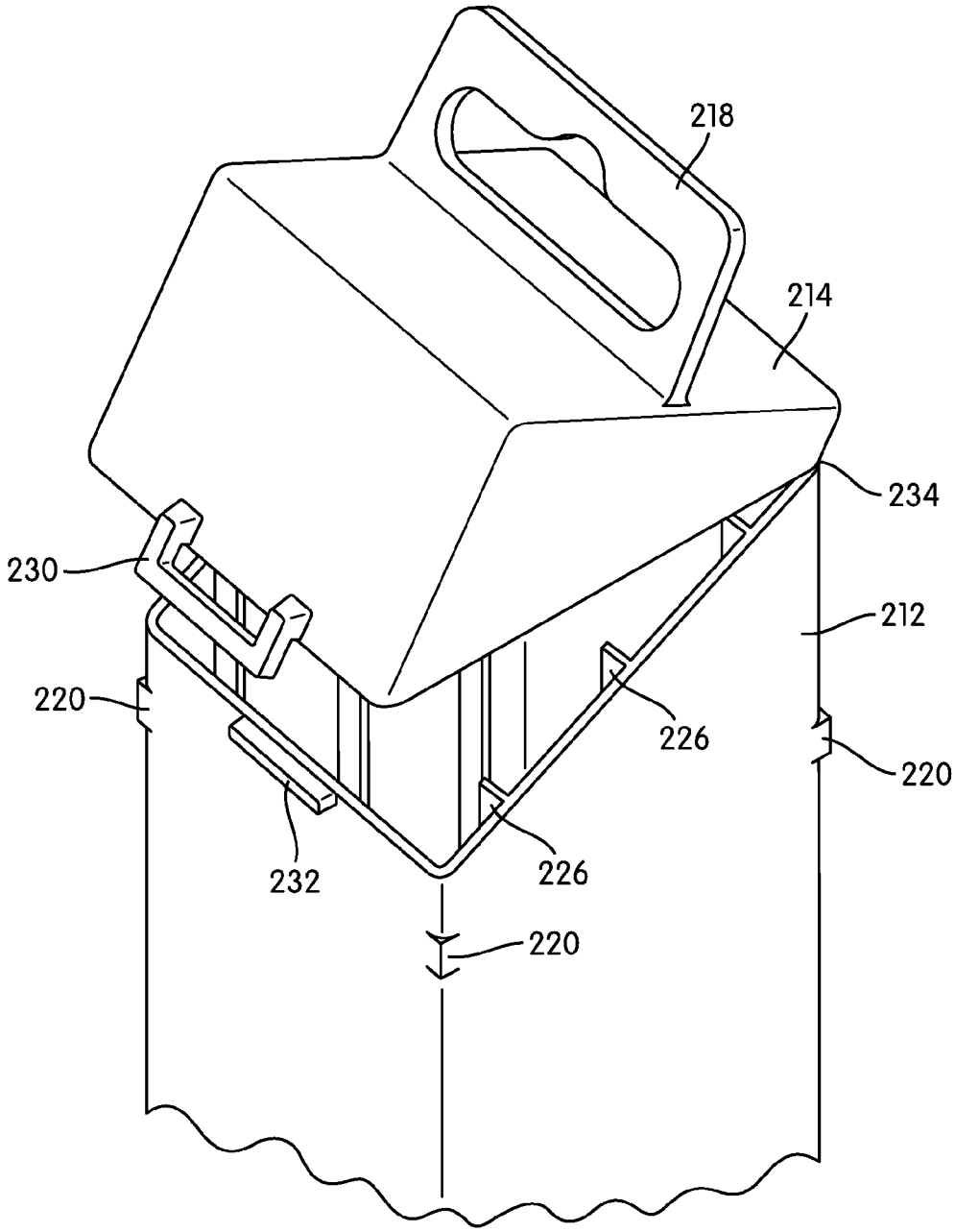
FIG. 11 is a perspective view in detail showing a commodity package in a partly open configuration in accordance with the embodiment of the present invention shown in FIG. 8.
Figure 12:
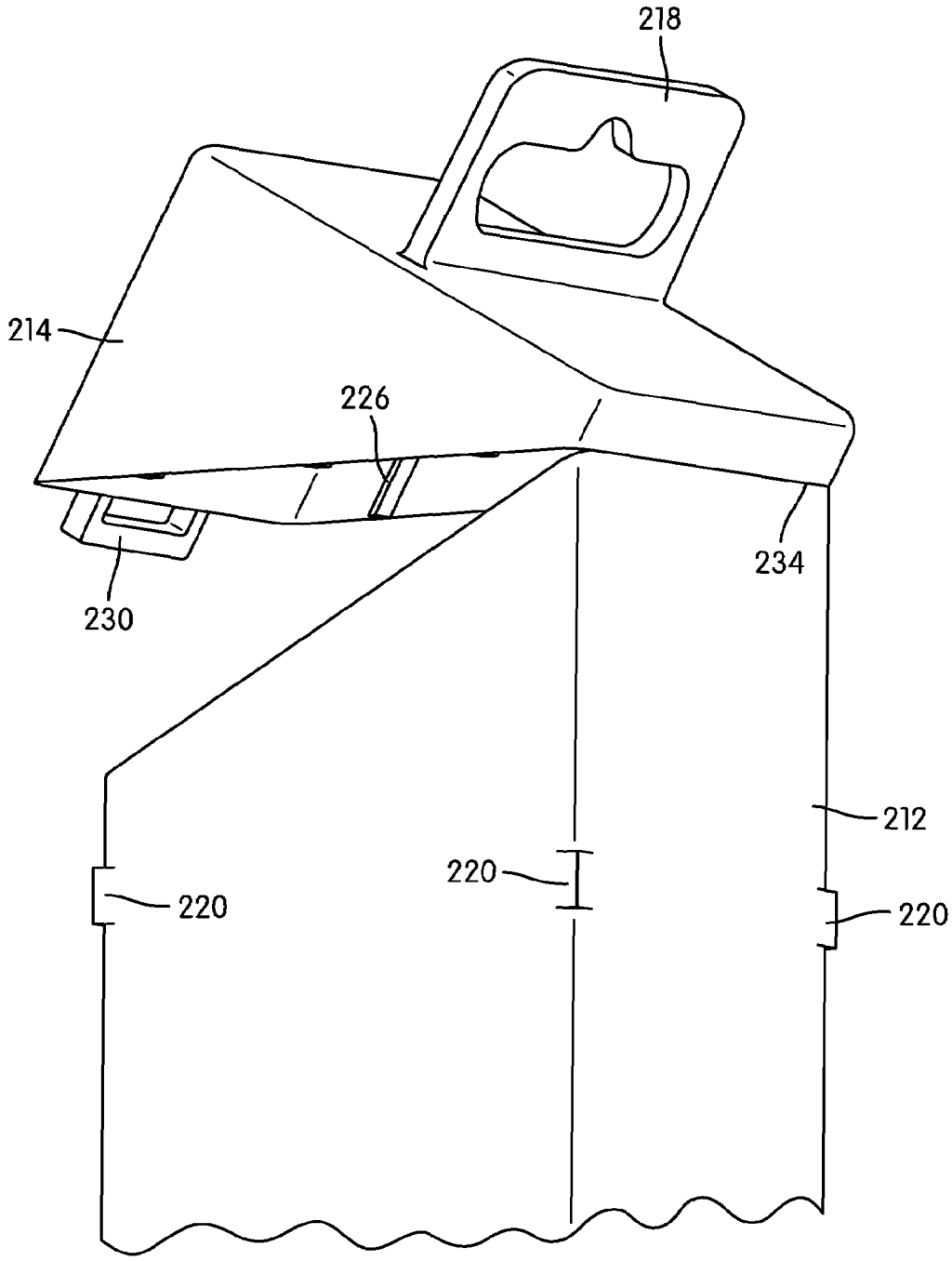
FIG. 12 is a rear perspective view in detail showing a commodity package in a partly open configuration in accordance with the embodiment of the present invention shown in FIG. 8.

A further embodiment of the present invention is shown in FIGS. 8-12. As shown in FIG. 8, a commodity package 210 includes a base container 212, a cover 214, hanger member 218, and projections 220, all of which may have the same or similar characteristics as the base container 12, a cover 14, hanger member 18, and projections 20, respectively, as described above with respect to a previous embodiment. Additionally, as shown in FIGS. 9-12, the interior ribs 226 may have the same or similar characteristics as the interior ribs 26 described above. Although not shown, the commodity package 210 may be sealed with shrink wrap 216 in the same or similar manner as described above with respect to the commodity package 10 and shrink wrap 16. Such shrink wrap 216 may include a tear-strip, seam, or perforation as described above to assist in opening the package 210.

The embodiment of the commodity package 210 shown in FIGS. 8-12 differs, however, from the commodity package 10 in the manner of securing the cover 214 to the base container 212 as well as in the manner of opening the package 210. Commodity package 210 may include a hinge mechanism, such as a living hinge 234, to permit access to the commodities located within the base container 212 and to maintain the base container 212 and the cover 214 in an attached relationship. The living hinge 234 may be configured to permit movement of the cover 214 relative to the base container 212 from (or to) a closed position (shown in FIG. 8) to (or from) an open position (shown in FIGS. 9-10) and positions between (shown in FIGS. 11-12).

The living hinge 234 may be formed during molding or other construction of the base container 212 and cover 214. The living hinge 234 may be formed integrally with and out of the same material as the base container 212 and cover 214. The living hinge 234 may have a reduced thickness relative to the walls of the base container 212 and cover 214 so that increased flexibility is provided, allowing pivoting movement between the base container 212 and the cover 214. One of skill in the art will appreciate that hinge mechanisms other than living hinges may be provided in the commodity package 210 in accordance with the present invention.

A latch 230 and anchor 232 may be provided on the front face of the cover 214 and base container 212, respectively, in order to maintain the package 210 in the closed position. The latch 230 may be configured so as to be movable away from the base container 212 just enough to clear the anchor 232 and be biased to return to its original position (shown in FIG. 8). The anchor 232 may be a strip of material configured to fit within a space defined by the latch 230 when the cover 214 is in the closed position.

To open the package 210, a user may pull outwardly and upwardly on the latch 230 so that it clears the anchor 232 and permits the cover 214 to open. To close the cover 214, a user may simply move the cover 214 to the closed position, the anchor 232 naturally fitting itself within the space defined by the latch 230. The latch 230 may alternatively be provided with a ramped surface (not shown) to help clear the anchor 232 and lock the latch 230 into place. One of skill in the art would recognize that any other suitable latch mechanism may be provided in order to enable repeated opening and closing of the cover 214 while securing the cover 214 to the base container 212 when in the closed position. The latch 230 and anchor 232 may be formed integrally with the base container 212 and cover 214, or hardware may be subsequently attached to the package 210.

To provide increased access to the commodities located within the base container 212, the interface between the base container 212 and the cover 214 may be sloped, or angled, as shown in FIGS. 8-12. As such, commodities located within the base container 212, e.g., commodities having a length approximately equal to the height of the package 210, may be grasped by a user when they are located in a frontal region of the base container 212. One of skill in the art will appreciate that the package 210 may be provided with a sloped interface angled in an opposite direction or with an interface that is curved rather than linear. An access opening may also be provided similar to that described with respect to the commodity package 10, above. Alternatively, a package 210 may be provided with a base container 212 and cover 214 interface that is not sloped.

While specific embodiments have been described above, it will be appreciated that the invention may be practiced otherwise than as described. The descriptions above are intended to be illustrative and not limiting. Thus it will be apparent to one skilled in the art that modifications may be made to the invention as described without departing from the scope of the claims set out below.

What is claimed is:

1. A staple package, comprising:

a generally rectangular cross section base container;

a generally rectangular cross section cover for cooperating with the base container and covering the base container;

interengaging structure provided on the base container and cover for releasably securing the cover to the base container;

shrink wrap disposed around the base container and the cover;

a projection formed on an exterior surface of the base container for inhibiting the shrink wrap from being removed from the base container; and a plurality of staples disposed within the base container.

2. The staple package of claim 1, wherein the base container telescopically receives the cover, and the interengaging structure being formed on an interior surface of the cover and an exterior surface of the base container.

3. The staple package of claim 1, further comprising a hanger member provided on the cover for hanging the package.

4. The staple package of claim 1, wherein the base container has an access portion opening in a surface of the base container to enhance access to the staples by a user.

5. The staple package of claim 1, wherein the shrink wrap has a tear-strip embedded therein to facilitate the opening of the package.

6. The staple package of claim 1, wherein the shrink wrap has a visual indication of a preferred cutting area to open the package.

7. A staple package, comprising:

a generally rectangular cross section base container;

a generally rectangular cross section cover for cooperating with the base container for covering the base container to provide a generally enclosed space;

shrink wrap disposed over the base container and the cover;

a projection formed on an exterior surface of the base container for inhibiting the shrink wrap from being removed from the base container; and a plurality of staples disposed within the base container, wherein the base container telescopically receives the cover, and further comprises interengaging structure formed on an interior surface of the cover and an exterior surface of the base container.

8. The staple package of claim 7, further comprising a hanger member provided on the cover for hanging the package.

9. The staple package of claim 7, wherein the base container has an access portion opening in a surface of the base container to enhance access to the staples by a user.

10. The staple package of claim 7, wherein the shrink wrap has a tear-strip embedded therein to facilitate the opening of the package.

11. The staple package of claim 7, wherein the shrink wrap has a visual indication of a preferred cutting area to open the package.

12. A staple package, comprising:

a generally rectangular cross section base container;

a generally rectangular cross section cover for cooperating with the base container for covering the base container to provide a generally enclosed space;

a plurality of staples disposed within the base container;

interengaging structure provided on the base container and cover for releasably securing the cover to the base container; shrink wrap disposed around the base container and the cover and ribs formed on an interior surface of the base container for inhibiting movement of the staples within the base container.

13. A package, comprising:

a base container;

a cover for cooperating with the base container to define a generally enclosed space, the base container telescopically receiving said cover;

a hanger member provided on the cover for hanging the package;

shrink wrap disposed around the base container and the cover;

a projection formed on an exterior surface of the base container for inhibiting the shrink wrap from being removed from the base container; and commodities disposed within said base container.

14. The package of claim 13, further comprising interengaging structure provided on the base container and cover for releasably securing the cover to the base container.

15. The package of claim 13, wherein the shrink wrap has a tear-strip embedded therein to facilitate the opening of the package.

16. The package of claim 13, wherein the shrink wrap has a visual indication of a preferred cutting area to open the package.

17. The package of claim 13, wherein the base container has an access portion opening in a surface of the base container to enhance access to the commodities by a user.

18. The package of claim 13, further comprising ribs formed on an interior surface of the base container for inhibiting movement of the commodities within the base container.

* * * * *